US008650686B2

(12) United States Patent
Biggie et al.

(10) Patent No.: US 8,650,686 B2
(45) Date of Patent: Feb. 18, 2014

(54) ADJUSTABLE WIDTH BARIATRIC TRANSPORT SUPPORT SURFACE

(75) Inventors: John J. Biggie, Coral Springs, FL (US); Lydia Biggie, Coral Springs, FL (US); John Gillis, Coral Springs, FL (US)

(73) Assignee: Anodyne Medical Device, Inc., Los Angeles, CA (US)

( * ) Notice: Subject to any disclaimer, the term of this patent is extended or adjusted under 35 U.S.C. 154(b) by 1073 days.

(21) Appl. No.: 11/164,314

(22) Filed: Nov. 17, 2005

(65) Prior Publication Data

US 2006/0101580 A1 May 18, 2006

Related U.S. Application Data

(60) Provisional application No. 60/522,901, filed on Nov. 18, 2004.

(51) Int. Cl.
*A47C 27/10* (2006.01)

(52) U.S. Cl.
USPC ..... 5/713; 5/600; 5/706; 5/711; 5/722; 5/739

(58) Field of Classification Search
USPC ..... 5/713, 600, 613, 706, 711, 722, 739
See application file for complete search history.

(56) References Cited

U.S. PATENT DOCUMENTS

| | | | | |
|---|---|---|---|---|
| 6,021,533 | A * | 2/2000 | Ellis et al. | 5/600 |
| 6,760,939 | B2 * | 7/2004 | Ellis et al. | 5/713 |
| 2001/0023511 | A1 * | 9/2001 | Wilkinson | 5/713 |
| 2002/0133883 | A1 * | 9/2002 | Perez et al. | 5/713 |
| 2003/0159219 | A1 * | 8/2003 | Harrison et al. | 5/713 |
| 2004/0255386 | A1 * | 12/2004 | Liu | 5/710 |
| 2006/0026768 | A1 * | 2/2006 | Chambers et al. | 5/713 |

* cited by examiner

*Primary Examiner* — William Kelleher
(74) *Attorney, Agent, or Firm* — Nixon & Vanderhye P.C.

(57) ABSTRACT

A specialty support surface for a variable width bed that can easily change its width from a wide bariatric mattress to a standard width so it can fit through a standard hospital door frame. The support surface can be placed on any bariatric bed frame that is designed to reduce its width to fit through a standard door. The support surface has the normal traverse air cells (used to reduce or relieve pressure). In addition, transverse air cells have independently controlled compartments on their ends. By inflating or deflating the controlled compartments, the length of the transverse air cells can be varied. These controllable compartments are controlled through an electronic controller by simply pressing a keypad on its touch panel. The electronic controller is used to control air pressure to the various compartments of the specialty support surface. The mattress replacement can be single or multi zone.

22 Claims, 3 Drawing Sheets

ADJUSTABLE WIDTH BARIATRIC TRANSPORT SUPPORT SURFACE

CROSS-REFERENCE TO RELATED APPLICATIONS

This application is related to, and claims the benefit of, the provisional patent application entitled "Adjustable Width Bariatric Transport Support Surface", filed Nov. 18, 2004, bearing U.S. Ser. No. 60/522,901 and naming John J. Biggie, Lydia Biggie and John Gillis, the named inventors herein, as sole inventors, the contents of which is specifically incorporated by reference herein in its entirety.

BACKGROUND OF THE INVENTION

1. Technical Field

The present invention relates to bariatric support surfaces. In, particular, it relates to a variable width bariatric support surface that can dynamically change its width when used in conjunction with a variable width transport bed frame.

2. Background

While most hospital beds are designed to support a standard range of patient sizes, there is an increasing need for both bed frames and support surfaces for the very large ("bariatric") patients who are between 350 and 1000 pounds. Bariatric patients are physically too large to fit on a standard hospital bed, which is usually 36" in width.

The industry has developed many bariatric bed frames and support surfaces in various widths. For larger bariatric patients, beds up to 60" in width may be required to support them. Constructing a conventional mattress of this size is not problem, and those mattresses are suitable in a situation where the patient is ambulatory, or does not have to be moved from one room to another while remaining in the bed. However, when a bariatric patient is in a hospital or long term health care facility, it is often necessary to move the bariatric patient from their room to other parts of the facility (such as for X-rays, therapy, etc.) while they remain in their bed. It would be desirable to have a method of moving bariatric patients from one room to another while they remain in their beds.

One attempt to address this problem uses a dual bed frame system that shares a single mattress with longitudinal side extensions. The first bed frame in this system is a bariatric bed that is sized for use by bariatric patients. The second bed frame in this system is a standard size bed that can be rolled through a doorway to move a patient from room to room. These bed frames share a single mattress which is approximately the size of a standard hospital mattress. When the patient is resting on the bariatric bed frame, one or more side extensions are attached to the sides of the mattress. The side extensions extend longitudinally along the side of the mattress from the head of the bed to the foot of the bed, and effectively increase the width of the mattress to provide a resting surface for the patient that extends to the full width of the bariatric bed frame.

The longitudinal extensions (or "bolsters,") can be detachable foam extensions, air filled cushions, coil spring supports, etc. During normal use, the patient rests on the bariatric bed using both the mattress and the longitudinal side extensions. These designs have a disadvantage in that there is always some gap or bumps between the longitudinal "bolster" and the lateral air cells used in alternating pressure systems. Also, some other systems have valves outside of the pump (i.e., the air source for the mattress) which must be manually switched over for inflating and deflating the bolster. Of course, this switching system requires additional parts and expense.

When the patient has to be moved from the patient's room, the second bed is brought into the patient's room. The longitudinal side extensions are either removed or deflated to reduce the width of the patient's mattress to the standard size. At this point, the patient's mattress is moved from the bariatric bed frame to the standard size bed frame. This type of system will typically have lateral lift supports that underlie the mattress and extend outward from the undersides of the mattress. The hospital or health care personnel will lift the mattress up from the bariatric bed and move the mattress to the standard size bed using the lateral lift supports. At this point, the patient is now ready to be moved out of the room.

While allowing movement of a bariatric patient out of a room, this approach has several significant drawbacks. First, it requires a substantial investment in equipment. It uses two complete frames rather than one. This substantially increases the cost of providing care to a bariatric patient. In addition, this type of system requires a large number of components to build and control the longitudinal side extensions. It also requires the additional cost of the lateral lift supports. It would be desirable to reduce costs by eliminating the need for a second bed frame, by eliminating the need for the lateral lift supports, and by eliminating the components required for the side extensions. Second, it requires a substantial amount of work for patient transfer. In particular, it requires that a sufficient number of personnel be available to physically move the patient from the bariatric bed frame to the standard bed frame. It would be desirable to eliminate the need to move a bariatric patient from one bed to another for the purpose of transporting the patient to another room.

A third disadvantage associated with multiple bed systems is that the longitudinal side extensions do not align perfectly with the mattress. As a result, high points or low points are created along the longitudinal length of the mattress used with this system. High points will cause pressure points on the patient's skin surface, which may lead to bed sores. Low points may result in patient entrapment or pressure points at other locations on the patient's skin surface due to poor pressure distribution.

As noted above, to overcome some of the problems associated with multiple bed frame systems, bed frames have been developed that can change width so they fit through the standard hospital door, which is approximately 40-42" wide. However, the prior art has not provided a variable width support surface that can function without the disadvantages found in the prior art. In particular, it would be desirable to have an inexpensive, variable width support surface with a minimum number of parts, and with a continuous flat surface without high points or low points that may injure a patient.

SUMMARY OF THE INVENTION

The present invention provides a specialty support surface for a variable width bed that can easily change its width from a wide bariatric mattress width to a standard width so it can fit through a standard hospital door frame. The support surface is a mattress replacement, which would be placed on any bariatric bed frame, but is preferably intended for use with a variable width bariatric bed that is designed to reduce its width to fit through a standard door. The mattress replacement has the normal transverse air cells (used to reduce or relieve pressure), but with special independently controllable compartments on the ends of the transverse air cells. By inflating or deflating the independently controlled compartments, the length of the transverse air cells can be varied. These independently controllable compartments are controlled through an electronic controller by simply pressing a keypad on its touch panel. The electronic controller is used to control air pressure to the various compartments of the specialty support surface. The mattress replacement can be single or multi zone. The independently controlled compartments, when inflated, form a continuous flat surface with the traverse cells in the middle of the specialty support surface, and thus do not produce any high points or low points in the support surface.

DESCRIPTION OF THE PREFERRED EMBODIMENT

Figure 1A:
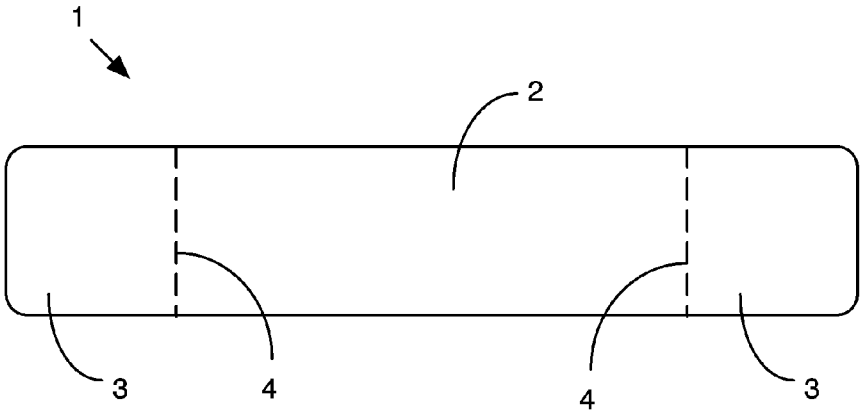
FIG. 1A is a top view of a preferred embodiment of the invention, which shows an air cell with an independently controllable compartment on either end.

Prior to a detailed discussion of the figures, a general overview of the system will be presented. The device provided by the invention is a specialty mattress replacement that has a series of transversely placed air cells (e.g., air cells that run laterally across the bed frame). Each air cell length, when fully inflated, is made to the extended width of a bariatric bed frame, but has the ability to reduce in size to a narrower width. The most common reduction in width is 10", however, each air cell can accommodate a variety of reduction dimensions. Air cells are preferably arranged laterally between the sides of the beds, with as many air cells in the mattress as required to make the mattress fit the length of the bed frame.

One or both ends of the air cells are sectioned off into independently controllable inflatable or deflatable compartments. By inflating or deflating these compartments, length of the air cells, and the width of the support surface, can be varied. Preferably, the center section of the air cells remains at a dimension such that they match the reduced width of the bed frame. Typically, this would be 40 inches. In its most basic form, each air cell has three air ports: one for the main center section, and one in each of two end sections. The center section of all the air cells can be connected by hoses to form one or more zones (i.e. head, trunk, foot). This plumbing allows for Alternating Pressure therapy as well as Static (float) and Low Air Loss therapy.

In its simplest form, all of the independently controllable compartments on each side of the mattress are attached together, either forming one zone or multiple zones. There is one hose(s) that connects all the end sections on the right side, and one hose(s) that connects all the end sections on the left side. Both of these end section hoses are connected in turn to an electronic controller. Those skilled in the art will recognize that independently controllable compartments can each be separately inflated or deflated. By independently controlling each compartment, the independently controllable compartments can be controlled in sequence with their associated central air cell for the purpose of providing a variety of pressure therapies.

An electronic controller is provided to control the support surface. There is a function key on the controller that can be operated when it is desired to transport the patient through a narrow doorway. When this function is activated, it suctions or vents the air out of the independently controllable compartments of the air cells on both sides of the mattress. This deflates the edge of the mattress, which allows the bed frame to be reduced in width to a narrower configuration. While the end sections are deflated, the rest of the support surface continues to operate in a normal manner, allowing alternating pressure, float/static, and/or low air loss therapies to continue. At the same time, the variable width bed frame would also be reduced in width.

When it is desired to adjust the bed frame and the mattress back to its wide position, the function key in the controller is again activated and the end section air cells on both sides of the mattress inflate. The variable width bed frame would also be increased in width at this time.

In the preferred embodiment, the electronic controller that provides air to the support surface has separate solenoid valves (the number of valves depends on the number of zones) which opens or closes either to allow air in, or allow air out (inflate or deflate). The pump works as a pressure source or a vacuum source (to inflate or deflate).

The end sections can be maintained at a controlled firm air pressure. This firm pressure has the advantage of helping to prevent "patient entrapment." Alternating Pressure support surfaces typically have low edge support along the sides of the bed frame. When a patient rolls towards the edge of the bed they may become trapped in the gap between the side rails and the mattress. The constant firm support all along the edge of the bed, provided by the end section air cells, helps fill in this gap and aids in preventing patient entrapment. Yet, with this present invention, there is no gap or bump between the main air cells and the end sections, as they are all part of the same air cell. This greatly adds to the patient's comfort and safety. In addition, as the present invention increases the edge support of the mattress, this greatly aids the bariatric patient when exiting from the bed.

Having discussed the invention in general, we turn now to a more detailed discussion of the figures.

FIG. 1A is a top view of a preferred embodiment of the air cell 1, which shows an air cell 2 with independently controllable compartments 3 extending from the lateral ends of the air cell 2. The dashed lines illustrate the location of the internal bulkhead 4 or weld line which separates the air compartments within the air cell 2. Those skilled in the art will recognize that the internal bulkhead can be fabricated by a discrete wall panel or by welding the walls of an air cell 2 together. If welded, any suitable method can be used, such as thermal welding, RF welding, etc. Likewise, adhesives can also be used. The only requirement is that whatever method is used to create internal bulkhead 4, the resulting structure should be suitable for its purpose.

Figure 1B:
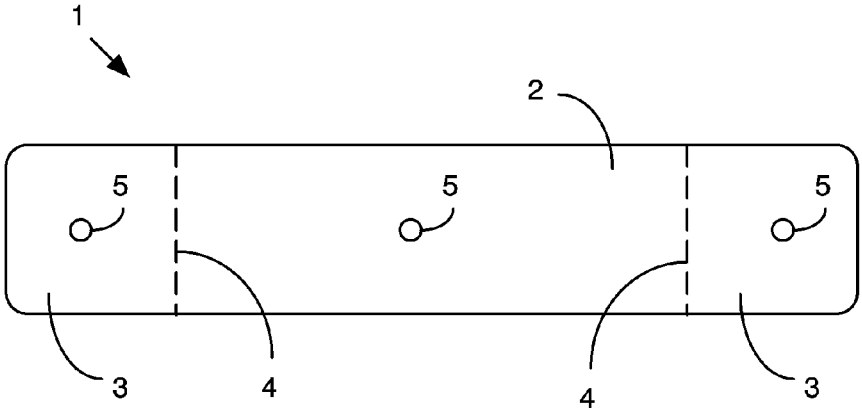
FIG. 1B is a bottom view of a preferred embodiment of the invention, which shows an air cell with an independently controllable compartment on either end. Inflation control ports are also shown.

FIG. 1B is a bottom view of a preferred embodiment of the air cell 1, which shows an air cell 2 with an independently controllable compartment 3 on either lateral end. Also shown are inflation control ports 5.

Figure 1C:
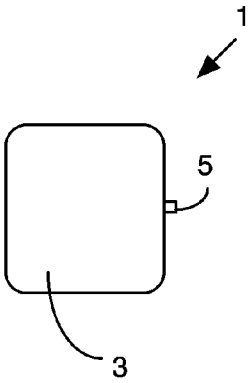
FIG. 1C is an end view of a preferred embodiment of the invention.

FIG. 1C is an end view of a preferred embodiment of the air cell 1.

Figure 2:
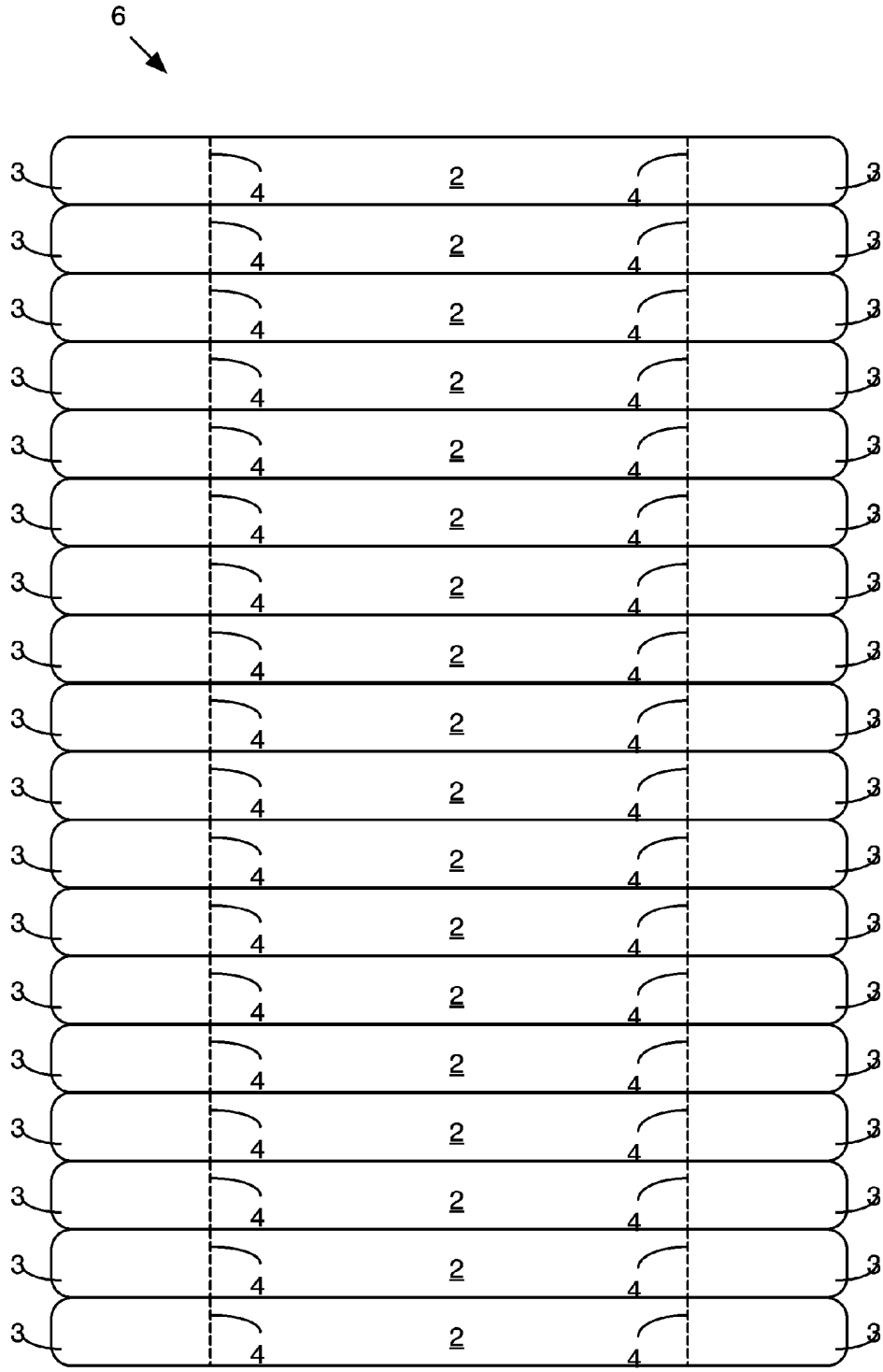
FIG. 2 illustrates a top view of a preferred embodiment of the invention which illustrates a support surface comprised of a series of adjacent air cells.

FIG. 2 illustrates a top view of a preferred embodiment of the invention which illustrates a support surface 6 comprised of a series of adjacent air cells 2, with independently controllable compartments 3 extending from their lateral ends.

Figure 3A:
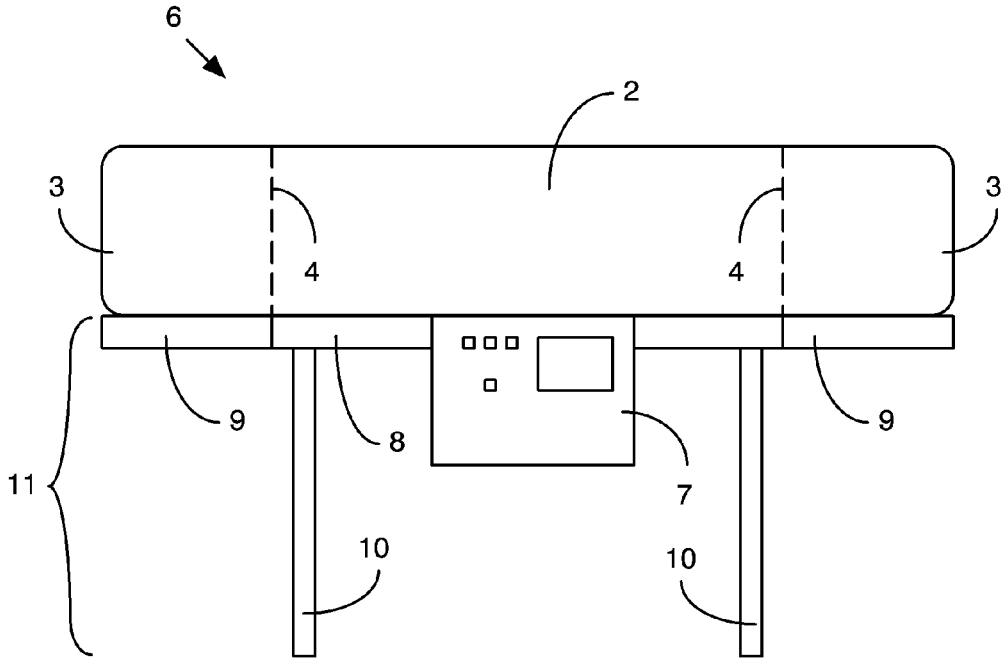
FIG. 3A illustrates an end view of a preferred embodiment of the support surface resting on an adjustable width bed frame. The independently controllable compartments on the sides of the support surface are shown in the inflated state. The bed frame is shown in the extended bariatric configuration.

FIG. 3A illustrates an end view of a preferred embodiment of the support surface 6 resting on an adjustable width bed frame 11. The independently controllable compartments 3 on the sides of the support surface 6 are shown in the inflated state. The bed frame 1 is shown in the extended bariatric configuration. In this configuration, the central support platform 8 provides support for the air cells 2 in the support surface 6. Extension platforms 9 are shown in the extended position. Central support platform 8 is supported on legs 10. Also shown is control panel 7 which is used to control the vacuum pump (not shown). The vacuum pump may be an integral part of control panel 7. Vacuum pumps and their controllers are well known in the art, and will not be discussed further.

For ease of discussion, the adjustable width bed frame 11 has been shown in either the standard width configuration, or in a fully extended configuration in which both extension platforms 9 are in the extended position, and both sets of independently controllable extensions 3 are inflated. However, those skilled in the art will recognize that an intermediate configuration is possible in which only one extension platform 9 is in the extended position, and only one set of independently controllable extensions 3 are inflated.

Figure 3B:
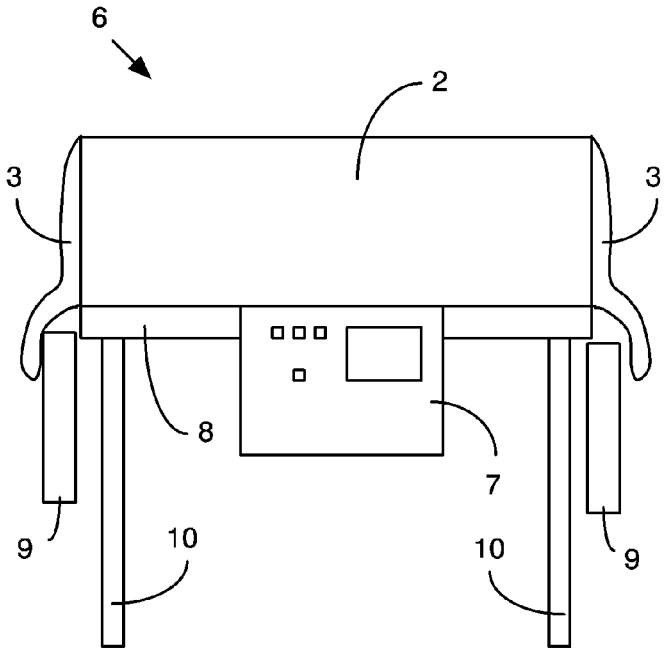
FIG. 3B illustrates an end view of a preferred embodiment of the support surface resting on an adjustable width bed frame. The independently controllable compartments on the sides of the support surface are shown in the deflated state. The bed frame is shown in the standard sized bed configuration.

FIG. 3B illustrates an end view of a preferred embodiment of the support surface 6 resting on an adjustable width bed frame 11. The independently controllable compartments 3 on the sides of the support surface 6 are shown in the deflated state. The bed frame 11 is shown in the standard sized bed configuration with the extension platforms 9 in the lowered position.

While the preferred embodiment envisions a plurality of air cells 2 forming the support surface, those skilled in the art will realize that is also possible to use a support surface in which a reduced number of air cells 2, or even single air cell 2, with a corresponding number of independently controllable compartments 3. This reduces manufacturing costs, and is satisfactory in situations, such as short-term use, where other therapies (e.g. alternating pressure, etc.) are not required.

While the invention has been described with respect to a preferred embodiment thereof, it will be understood by those skilled in the art that various changes in detail may be made therein without departing from the spirit, scope, and teaching of the invention. For example, the number and configuration of the chambers within the air cell may vary, and the materials used to fabricate the support surface 6 may vary.

We claim:

1. An adjustable width support surface, for use with adjustable width bed frames or bed frames of fixed, but various widths, comprising:

a plurality of inflatable air cells defining the support surface in its entirety and each including an inflatable central section, the plurality of inflatable air cells each further having at least one independently controllable compartment connected to and extending from a lateral end of the inflatable central section; and a controller communicating with the at least one independently controllable compartment, the controller selectively varying a width of the entire support surface by inflating or deflating the at least one independently controllable compartment.

2. A support surface, as in claim 1, wherein:

each of the inflatable air cells has two independently controllable compartments, one independently controllable compartment extending from one lateral end of the inflatable central section, and the other independently controllable compartment extending from the opposite lateral end of the inflatable central section; and the controller communicating with both independently controllable compartments, such that by inflating or deflating them, the width of the support surface can be varied.

3. A support surface, as in claim 2, wherein:

the controller can independently inflate or deflate each independently controllable compartment such that the support surface can have a standard width configuration, a fully extended width configuration, or an intermediate width configuration in which only one independently controllable compartment is inflated.

4. A support surface, as in claim 2, wherein:

each of the inflatable air cells is aligned with adjacent inflatable air cells such that their lateral ends are substantially aligned with one another.

5. A support surface, as in claim 4, wherein:

the support surface has a length substantially corresponding to a length of a standard size bed; and the support surface has a width substantially corresponding to a width of a standard size bed when the independently controllable compartments are deflated, and to an extended width when the independently controllable compartments are inflated.

6. A support surface, as in claim 4, wherein:

each independently controllable compartment is associated with a particular inflatable air cell, and is an integral part of its associated inflatable air cell.

7. A support surface, as in claim 6, wherein:

an outer surface of the inflatable air cell, and its associated independently controllable compartments are fabricated from a single sheet of material or two sheets of material; and the independently controllable compartments are separated from their associated inflatable central sections by an internal wall, a bulkhead, or by a welded seam between each independently controllable compartment and its associated inflatable central section.

8. A support surface, as in claim 7, wherein:

the outer surface of each inflatable air cell and its associated independently controllable compartments, when inflated, form a substantially smooth surface without projections or gaps.

9. A support surface, as in claim 4, further comprising:

a first air conduit providing air pressure from the controller to the inflatable air cells; and at least a second air conduit providing air pressure from the controller to the independently controllable compartments.

10. A support surface, as in claim 9, further comprising:

a third air conduit providing air pressure from the controller to the independently controllable compartments, the second air conduit connected to the independently controllable compartments on one side of the support surface, and the third air conduit connected to the independently controllable compartments on the other side of the support surface.

11. A support surface, as in claim 4, wherein:

the controller opens a valve which is associated with the independently controllable compartments to allow the independently controllable compartments to deflate.

12. A support surface, as in claim 11, wherein:

the valve is a solenoid valve.

13. A support surface, as in claim 10, wherein:

the controller deflates the independently controllable compartments by applying suction pressure to the second and third air conduits.

14. A support surface, as in claim 4, wherein:

the controller rapidly deflates the independently controllable compartments with suction pressure.

15. A method of adjusting a width of a support surface for adjustable width bed frames, including the steps of:

inflating a central section of a support surface, having a plurality of inflatable air cells with independently controllable compartments at each end of the central section; and varying the width of the support surface in its entirety by deflating or inflating the independently controllable compartments to extend or retract the width of the support surface.

16. A method, as in claim 15, including the additional step of:

using a controller to control a pump that provides air pressure in the independently controllable compartments.

17. A method, as in claim 16, including the additional step of:

using the pump to individually inflate the inflatable air cells and the independently controllable compartments via air pressure, and to deflate the independently controllable compartments via suction pressure.

18. An adjustable width support surface, for use with adjustable width bariatric bed frames, comprising:

a plurality of inflatable air cells, secured to one another, and defining the support surface in its entirety;

each inflatable air cell having an associated pair of independently controllable compartments connected to and extending from respective lateral ends of an inflatable central section; and a controller communicating with the independently controllable compartments, the controller selectively varying a width of the entire support surface by inflating or deflating the independently controllable compartments.

19. A support surface, as in claim 18, further comprising:

a pump that inflates the independently controllable compartments via air pressure, and/or deflates the independently controllable compartments via suction pressure.

20. A support surface, as in claim 19, wherein:

an outer surface of the inflatable air cell, and its associated independently controllable compartments are fabricated from a continuous sheet of material; and the independently controllable compartments are separated from their associated inflatable central sections by an internal wall or bulkhead between each independently controllable compartment and its associated inflatable central section; and the outer surface of each inflatable air cell and its associated independently controllable compartments, when inflated, form a substantially smooth surface without projections or gaps.

21. A support surface, as in claim 18, wherein:

the inflatable air cells are grouped into zones, each zone being supplied with air pressure from one of a plurality of air conduits; and the controller independently controlling the air pressure in the respective zones such that some zones are fully inflated and some are not, the controller further varying the zones such that alternating pressure therapy is provided by the support surface.

22. A support surface, as in claim 18, wherein:

the controller maintains an air pressure in the independently controllable compartments at a sufficiently high level to keep them in a rigid state.

* * * * *